US005127323A

United States Patent [19]

Lindblom

[11] Patent Number: 5,127,323

[45] Date of Patent: Jul. 7, 1992

[54] APPARATUS FOR ADJUSTING THE WEB TENSION OF A WEB-FED PRINTING PRESS

[75] Inventor: Kurt L. Lindblom, Trollhättan, Sweden

[73] Assignee: MAN Miller Druckmaschinen GmbH, Geisenheim, Fed. Rep. of Germany

[21] Appl. No.: 746,970

[22] Filed: Aug. 19, 1991

[30] Foreign Application Priority Data

Aug. 18, 1990 [DE] Fed. Rep. of Germany ..... 4026238

[51] Int. Cl.[5] ..... B41F 13/02; B41L 21/12

[52] U.S. Cl. ..... 101/228

[58] Field of Search ..... 101/228, 219, 212, 216, 101/181, 227, 348; 226/195, 199, 30, 175, 181, 183, 185, 190, 191

[56] References Cited

U.S. PATENT DOCUMENTS

| | | | |
|---|---|---|---|
| 3,203,345 | 8/1965 | Gibbons | 101/228 X |
| 3,537,631 | 11/1970 | Fujii | 226/191 |
| 4,205,770 | 6/1980 | Wojdyia | 101/228 |
| 4,961,378 | 10/1990 | Balow et al. | 101/228 |

*Primary Examiner*—J. Reed Fisher

*Attorney, Agent, or Firm*—Spencer, Frank & Schneider

[57] ABSTRACT

An apparatus for controlling the tension of a web material passing through a web-fed printing press includes two parallel shafts, at least one of which can be rotatably driven, and four rings, with two of such rings being spaced apart and fixed to the ends of each shaft. The casings of the two rings fastened to one of the upper and lower shafts is made of an elastically resilient material and includes slots. Each ring having a slotted casing further includes spreading elements disposed beneath the slotted casing for adjusting the diameter of the slotted casing, thereby partially controlling the tension of the web material passing through the gaps.

11 Claims, 1 Drawing Sheet

APPARATUS FOR ADJUSTING THE WEB TENSION OF A WEB-FED PRINTING PRESS

CROSS REFERENCE TO RELATED APPLICATIONS

The present application claims the rights of priority with respect to application Ser. No. P 40 26 238.3 filed Aug. 18th, 1990 in Germany, the subject matter of which is incorporated herein by reference.

BACKGROUND OF THE INVENTION

This invention relates to an apparatus for adjusting the tension of a web material passing through a web-fed printing press, particularly a web-fed offset printing press.

Prior art apparatus of this type includes two parallel shafts, at least one of which can be rotatably driven, and four rings, with two of such rings being spaced apart and fixed to the ends of each shaft such that the web material passes through the gaps between the mutually facing rings. The tension of the web material is controlled, for example, by adjusting the rate of rotation of the shafts.

SUMMARY OF THE INVENTION

It is an object of the invention to provide an additional control for making fine adjustments of the web tension.

The above and other objects are accomplished in the context of an apparatus of the above type, wherein, the casings of the two rings fastened to one of the upper and lower shafts are made of an elastically resilient material and include slots, and each ring having a slotted casing further includes spreading elements disposed beneath the slotted casing for adjusting the diameter of the slotted casing, thereby partially controlling the tension of the web material passing through the gaps.

With these measures it is possible to adjust the diameter of at least one of the pairs of rings, preferably of both pairs of rings. Since the ring casings are slotted, if the active diameter of the spreading elements is enlarged by suitable measures, the diameter of the ring casings increases correspondingly, and thus the overall diameter of the rings is enlarged.

If the active diameter of the spreading elements is then reduced, the slotted ring casings contract because of their elastically resilient characteristics and thus reduce the diameter of the rings. For that reason, the casings should be composed of spring steel or some other suitable elastically resilient material.

It is preferred for the inner faces of the ring casings to be conical, such that the diameter of the respective inner faces is maximum at the outer end of the casings. Mating faces of the spreading elements have the corresponding conicity and lie against the conical inner faces of the casings. The spreading elements are axially displaceable. Preferably, the spreading elements are configured as round wedges.

According to an aspect of the invention, the axial displacement of the spreading elements is effected by way of adjustment screws or adjustment nuts, or by way of other suitable drives, for example by way of pneumatic or motor drives. Return screws may be provided for returning the spreading elements.

In a preferred embodiment, the slots have an axial orientation. The slots may also extend in the radial direction of the shaft, emanating alternatingly from the outer surface and the inner surface of the casing. According to another embodiment, the slots may be spiral-shaped, it being important that the diameter of the end of the respective ring casings is able to change as a result of the slots.

According to another aspect of the invention, the outer surface of the ring casings has a greater coefficient of friction than those of the prior art. Thus, sliding of the passing web material relative to the surface of the rings is prevented and control of the web tension also becomes noticeably more precise.

Several alternative embodiments are available to obtain the desired increase in the coefficient of friction. Preferred embodiments include roughening of the casing surface, application of longitudinal ribs to the casing surface, oxidizing the material of the casing surface and/or plating the material of the casing surface with manganese.

The invention will now be described and explained in greater detail with reference to the drawing figures.

DETAILED DESCRIPTION OF PREFERRED EMBODIMENTS

Figure 1:
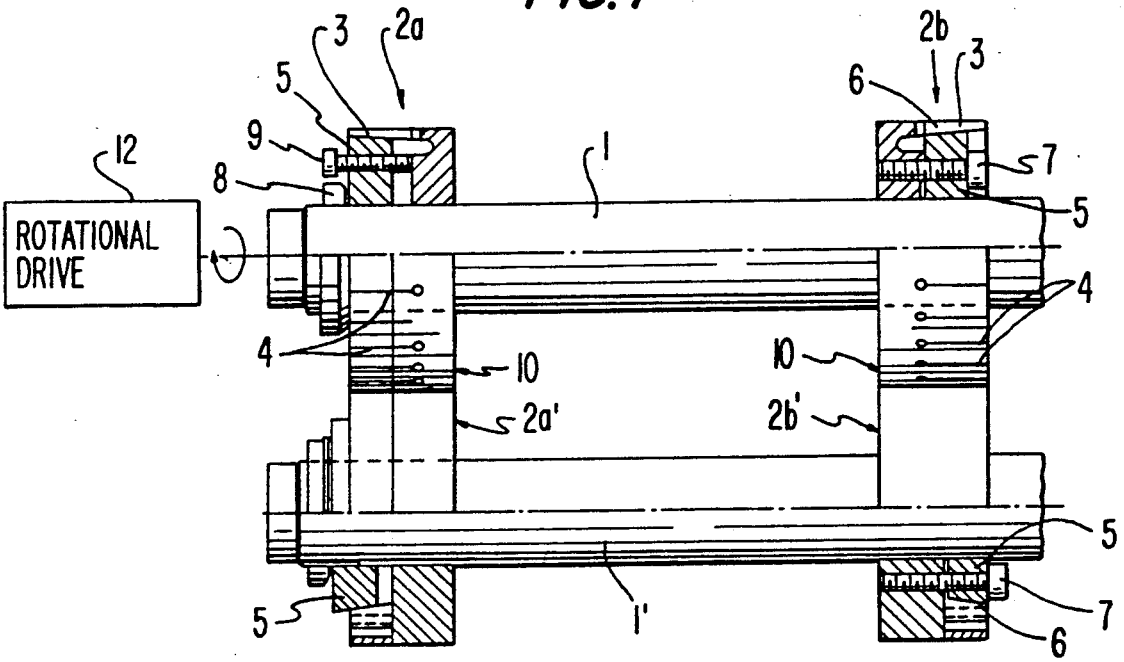
FIG. 1 shows a top elevation in partial section of an apparatus according to the invention.

Referring to FIG. 1, two rings 2*a*, 2*b* are seated at opposite ends, respectively, of an upper shaft 1 which may be rotatably driven at an adjustable speed by a rotational drive 12. Similarly, two rings 2*a*', 2*b*' are seated at opposite ends, respectively, of a lower shaft 1'. Rings 2*a*, 2*b* on upper shaft 1 each have an outer casing 3 provided with slots 4 extending in the longitudinal direction. The casings 3 are made of an elastically resilient material, preferably of spring steel.

Figure 2:
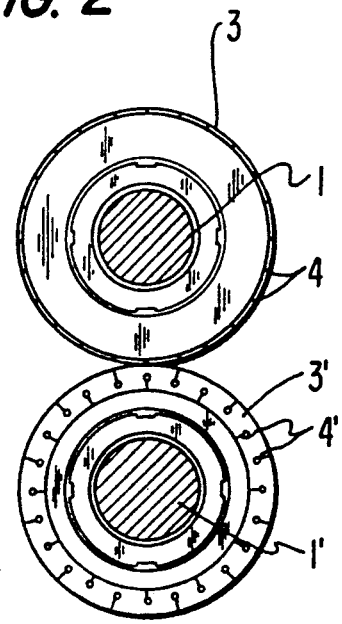
FIG. 2 shows a side view of an apparatus incorporating features of the invention.

In another embodiment, casings 3' have slots 4' extending in a radial direction of the rings, alternatingly beginning from an outer surface and an inner surface of casing 3', as shown at the bottom of FIG. 2.

On the right side of FIG. 1, a spreading element 5 is shown as driven maximally into casing 3, so as to expand the diameter of casing 3 to its maximum value. On the left side of FIG. 1, spreading element 5 is shown as retracted maximally from casing 3 so as to reduce the diameter of casing 3 to its minimum value.

Spreading elements 5 are shown in FIG. 1 as conically tapered, round wedges. The outer faces of the spreading elements become conically wider toward the exterior, that is, toward their ends. Casings 3 contain correspondingly conically tapered inner faces 6 so that the outer face of spreading elements 5 lies against inner surface 6 of casings 3.

A screw 7 may be provided to adjust spreading element 5 as shown on the right in FIG. 1. Alternatively, a nut 8 is used to adjust spreading element 5, as shown on the left in FIG. 1. In this latter case, shaft 1 is threaded (not shown) to correspond with inner threads (not shown) of nut 8, so that when nut 8 is rotated it is axially displaced along shaft 1. Return screws 9 are provided to return spreading elements 5, i.e., to moving spreading elements axially in a direction opposite to that caused by screw 5 and nut 8.

It can be seen that an axial displacement of spreading elements 5 causes the outer diameters of rings 2*a*, 2*b* to be changed correspondingly, with the change in the diameters and thus in the circumference of the rings being very small. The amount of change in diameter is a function of the degree of conicity of the mutually contacting faces of the spreading elements 5 and of the casings 3 or 3'.

Preferably, the diameters of all four rings 2a, 2b , 2a', 2b' will be adjustable; at least, however, rings 2a, 2b of upper shaft 1 or rings 2a, 2b of lower shaft 1' will be adjustable.

The paper web travels in a gap 10 between mutually opposed pairs of rings 2a, 2a' and 2b, 2b', with the rings transporting the web material along its unprinted edges.

The region of the web material disposed between the rings is not contacted by the rings so that the freshly printed image existing there is not smudged.

Preferably, casings 3 have an outer surface provided with a relatively high coefficient of friction to minimize sliding of web material relative to the surface of the rings and thus maximize control of the web tension. The coefficient of friction of the outer surface of casings 3 may be increased, for example, by roughening of the casing surface, application of longitudinal ribs, to the casing surface, oxidizing the material of the casing surface and/or plating manganese onto the casing surface.

Additional control of the web tension may be provided in combination with the above by adjusting the rotational velocity of at least one of the shafts 1, 1' by a suitable rotational drive mechanism 12 as shown in FIG. 1.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An apparatus for setting a tension of a web material passing through a web-fed printing press comprising:

an upper shaft and a lower shaft, at least one of said shafts being rotatably driven; and four rings, two of which are spaced apart and fastened to said upper shaft and two of which are spaced apart and fastened to said lower shaft, said two rings fastened to said upper shaft being essentially opposed to said two rings fastened to said lower shaft to define gaps through which web material can pass, with said two rings fastened to at least one of said upper and lower shafts each having a casing made of an elastically resilient material and including slots, and each ring having a slotted casing further including spreading means disposed beneath said slotted casing for adjusting a diameter of said slotted casing, thereby partially controlling the tension of the web material passing through the gaps.

2. An apparatus as defined in claim 1, wherein each said slotted casing has an interior face with a conical shape having an angle that opens toward an end of said casing, and each said spreading means includes a mating, axially displaceable, spreading element which has a conical shape corresponding to the conical shape of, and which lies against the interior face of a respective slotted casing, and means for axially displacing said spreading element relative to said slotted casing.

3. An apparatus as defined in claim 2, wherein each said spreading element has a shape of a round wedge.

4. An apparatus as defined in claim 2, wherein said axially displacing means includes one of an adjustment screw and an adjustment nut operatively engaged with at least one of said spreading element and said slotted casing.

5. An apparatus as defined in claim 1, wherein said spreading means includes a return screw operatively engaged with one of said spreading element and said slotted casing.

6. An apparatus as defined in claim 1, wherein said slots extend in an axial direction of said slotted casing.

7. An apparatus as defined in claim 1, wherein said slots extend in a radial direction of said slotted casing.

8. An apparatus as defined in claim 7, wherein said radial extending slots start alternatingly from an outer side and an inner side of said slotted casing.

9. An apparatus as defined in claim 1, wherein the casing of each said ring has an outer surface with a high coefficient of friction.

10. An apparatus as defined in claim 9, wherein the outer surface of each said casing is at least one of roughened, provided with longitudinal ribs, oxidized and plated with manganese.

11. An apparatus as defined in claim 1, and further including means for adjusting the rotational velocity of at least one of said shafts.

* * * * *